United States Patent [19]

Chaygneaud-Dupuy

[11] Patent Number: 4,913,691

[45] Date of Patent: Apr. 3, 1990

[54] DEVICE FOR ASSEMBLING CUTTINGS MORE PARTICULARLY FOR THE PRODUCITON OF PACKING BOXES

[75] Inventor: François Chaygneaud-Dupuy, Dignac, France

[73] Assignee: Dupuy Engineering S.A., D'Espagnac, France

[21] Appl. No.: 159,149

[22] Filed: Feb. 23, 1988

[30] Foreign Application Priority Data

Feb. 24, 1987 [FR] France ..... 87 02381

[51] Int. Cl.[4] ..... B31B 1/12; B31B 1/62

[52] U.S. Cl. ..... 493/2; 493/16; 493/123; 493/110; 493/128; 493/147; 198/689.1

[58] Field of Search ..... 493/96, 110, 123, 128, 493/147, 150, 2, 16; 271/157, 158, 159, 146, 221, 223, 224; 414/36, 45, 118, 900; 198/689.1

[56] References Cited

U.S. PATENT DOCUMENTS

| | | | |
|---|---|---|---|
| 2,015,202 | 9/1935 | Stokes | 493/110 |
| 2,690,337 | 9/1954 | Halahan et al. | 271/159 |
| 2,734,744 | 2/1956 | Backhouse | 271/159 |
| 3,030,867 | 4/1962 | Wright | 414/36 |
| 3,392,637 | 7/1968 | Back | 493/96 |
| 3,480,160 | 11/1969 | Smith et al. | 414/36 |
| 4,130,207 | 12/1978 | Cogswell et al. | 414/36 |
| 4,650,448 | 3/1987 | Urso | 493/110 |
| 4,740,193 | 4/1988 | Frost et al. | 271/197 |

*Primary Examiner*—Frederick R. Schmidt
*Assistant Examiner*—Jack W. Lavinder
*Attorney, Agent, or Firm*—Sughrue, Mion, Zinn, Macpeak & Seas

[57] ABSTRACT

This invention relates to a device for the assembling of cuttings, more particularly for the production of packing boxes, of the type including a plurality of work places arranged along a main vacuum conveyor, the work places consisting mainly of a first margin stop system (8) with at least one stack loader (66) and one conveyor (9) intended to position a first cutting on said main conveyor, at least one gumming machine (10) designed to apply a film of glue on at least a portion of the first cutting and at least a second margin stop system (11) with a stack loader and a conveyor intended to position a second cutting on the first cutting.

The main conveyor according to this invention is a linear horizontal type with at least one notched belt (2), guided in a slide (3) whose depth is slightly less than the thickness of the notched belt (2).

17 Claims, 6 Drawing Sheets

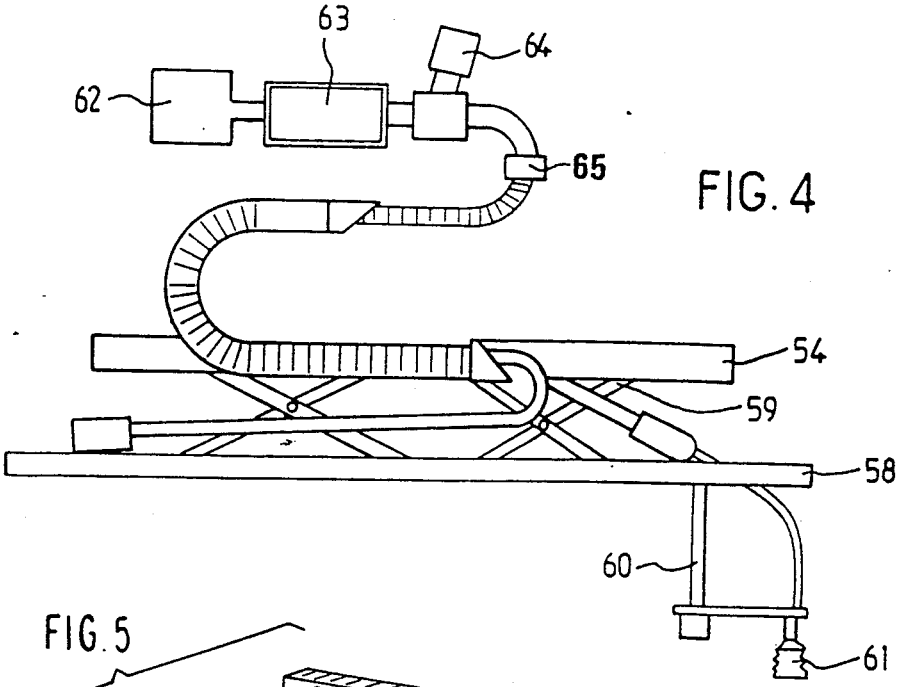
FIG. 4
FIG. 5
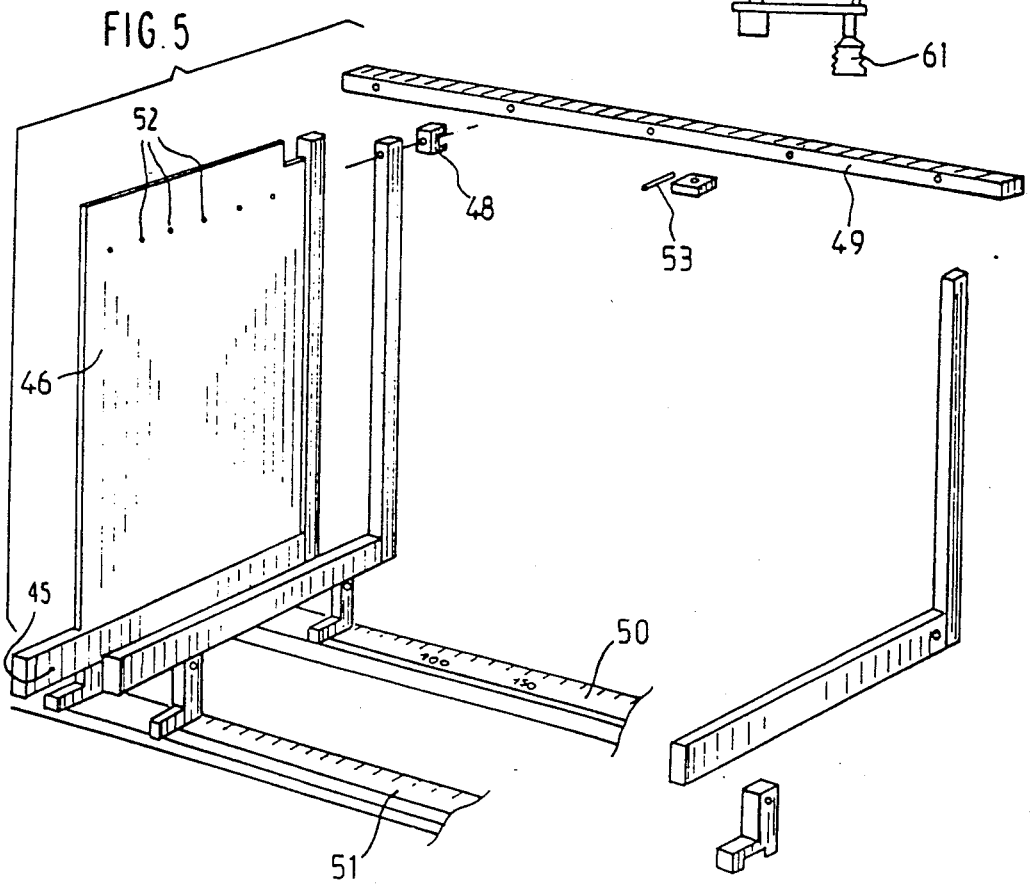

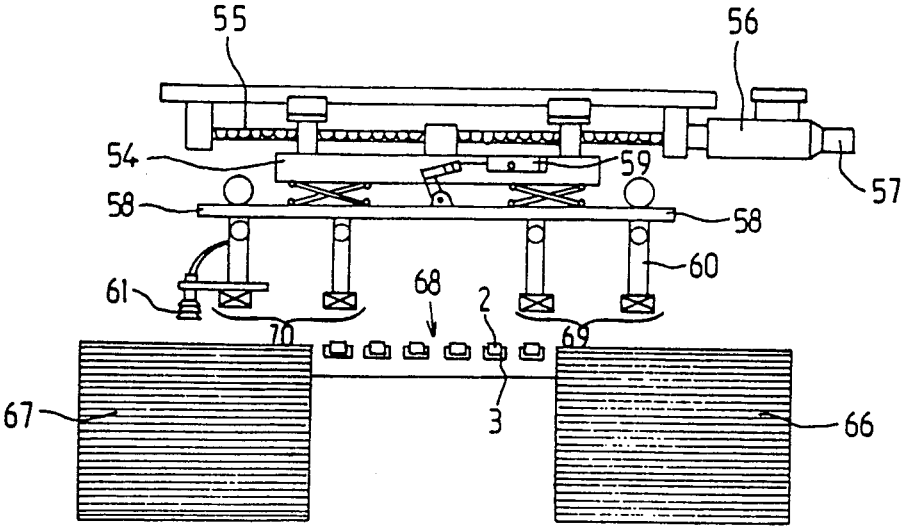
FIG. 6
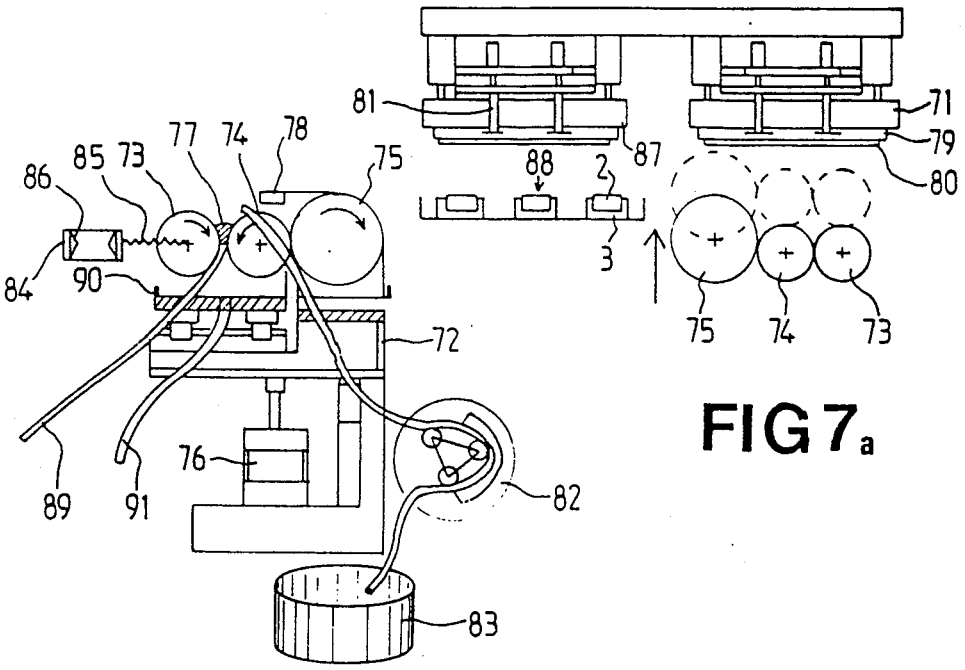
FIG 7a
FIG 7b

DEVICE FOR ASSEMBLING CUTTINGS MORE PARTICULARLY FOR THE PRODUCITON OF PACKING BOXES

This invention relates to a device for assembling cuttings, more particularly cuttings intended for the production of packing boxes, of the type that consists of a plurality of working places distributed around a main vacuum conveyor, said working places including margin stop systems with a stack loaded and a conveyor and gluing machines consisting of a glue feed and a mobile carrying carriage.

In the prior art, automatic systems for the assembling of pieces have been known, more particularly in respect of cardboard and plastic material pieces, involving a number of work places arranged around a central plate. The U.S. Pat. No. 4,713,046 by the applicant more specially refers to an automatic device including a circular horizontal disk rotating around a vertical axis, a plurality of vacuum chambers arranged on said disk and connected with a vacuum source that are intended to accommodate the cuttings to be assembled as well as a plurality of working places arranged around the disk in pre-set angular positions.

Cuttings are placed on the suction chamber and are kept in their position by the effect of the suction.

According to the Patent, cutting feeding devices include a framework in radial arrangement with respect to the disk extending partially above said disk, a table capable of moving vertically on said frame that is designed to collect said loose cuttings, a frame capable of moving along radial rails provided at the top end of said frame that may be moved from a first radial position in which it extends above said disk to a second radial position in which it extends above a suction chamber of said disk, a plurality of suction cups arranged on cross members of said mobile frame that are connected with a vacuum source, control means in order to move said frame or said cross members to a low position for taking and unloading cuttings and to a high position for the transfer motion of said frame from any of said positions to another.

The device according to the prior state of art provides a satisfactory accuracy in the positioning of cuttings and assembling for most usual packing boxes. However it does not permit the production of such boxes which require a high precision in the assembling of cuttings. On the other hand, the supply of cuttings to the work place intended to load the suction chamber makes it necessary to stop the device for a relatively long period.

Moreover any change in the type of box to be processed requires the substitution of a large number of parts in the load systems so that the device is stopped for a not insignificant period of time.

This invention is aimed at remedying the above disadvantages by providing a quick-working, variable automatic device for the assembling of cuttings ensuring a high accuracy of operation.

More particularly, the invention permits to accurately position a great number of glue bands on multiple cuttngs. It is possible to obtain packing boxes by assembling a variety of cuttings with diversified configurations.

Besides, any change required in the size and the type of boxes does not require any mechanical intervention on the main conveyor.

The device of the invention more specifically relates to a device for assembling cuttings, particularly for making packing boxes, in which there are a plurality of work places around a linear vacuum main conveyor provided with longitudinal suction chambers, said work places including margin stop systems fitted with stack loader and conveyor, as well as glueing machines including a glue feed and a mobile cushion carrying carriage, and said main conveyor comprising at least one timing belt moving above a plurality of vacuum chambers.

It is on advantage to design the timing or notched belts so that they are guided at regular spaces by ground rails, the depth of the groove of which is slightly less than the thickness of said notched belts.

The use of a main conveyor according to this invention gives the possibility to achieve a highly accurate positioning of cuttings and therefore a positioning well within control of cuttings at the work places.

According to a particular form of embodiment, notched belts are driven by a numeric control step-by-step motor.

According to a particular form of embodiment, the main conveyor is provided on the exit side with a discharge area including a mobile carriage with at least one suction chamber moving transversally from a position above the main conveyor to a position above the discharge area.

According to an advantageous form of this invention, the suction chamber includes an air outlet that co-operates with a fixed flap when the mobile carriage has moved to a vertical position above the discharge area.

According to a particular embodiment, said main conveyor includes at least one pattern recognition system in order to check the conformity of cuttings against a reference.

The main notched belt conveyor according to the invention makes it possible to have a very accurate positioning of cuttings and the identification of the positioning of the second cutting with respect to the first cutting is made by sensing the motion of the main conveyor. This detection is made by pulse counting when notched belts are driven by a step-by-step motor. The object of the pattern recognition system is not to control the motion of the main conveyor but to prevent the admission of bastard pieces at the subsequent work places and to cause their rejection.

This invention also relates to a device for the assembling of cuttings including a cutting feed station comprising a stack loader with a lifting frame that carries a removable rake and a lower fixed open type table with a comb configuration in whose space width the said rake can be introduced.

The stack loader comprises a lower fixed table provided with adjustable rails intended for holding dividing plates as provided to ensure the side positioning of cutting stacks.

The positioning of the top of the cutting stack is achieved by a vibration belt provided with aligning stoppers.

In addition to the stack loader, the margin stop system includes a conveyor consisting of a mobile carriage moved horizontally by a ball screw system, said carriage carrying a vertically adjustable plate that is fitted with air cups connected with a vacuum pump on the one side and with an air injection system on the other side.

In an alternative form of embodiment, said carriage carries a double plate with two rows of air cups.

The margin stop system consists of two stack loaders, symmetrically arranged on either side of the main conveyer and of a conveyor with a carriage moved horizontally by a ball screw system, said carriage supporting a double plate moved vertically by cylinders, said double plate being provided with two rows of air cups, with one air cup row picking the set of cuttings available on the tops of the stacks of the first loader, while the other air cup row unloads the sheets from the second loader onto the conveyor.

At least one of the work places is a glueing machine with a glue feeding system, with roller supports and several rollers, with a peristatic pump to feed the glue between said rollers through a suitable tubing, and a cushion carrying mobile carriage provided with a cell-type grid to permit the fitting of a glue cushion appropriate for the surface to be gummed, said cell-type grid being equipped with stripping points.

In a specially advantageous embodiment, the glue feeding system also has a water supply at said rollers, as well as a collecting pan for rinsing water.

Rollers are mounted on the laterally mobile support and the mutual pressure of rollers is ensured by pressing springs.

It is of advantage to design the glue cushion with a greater speed than that of the roller at the edges of the glueing area.

The operation of the various work places and the running and stop cycles of the main conveyor are controlled by a N.C. unit.

The device of the invention is particularly suitable for the production of packing boxes made of cardboard, plastic material, wood, metal or other material pieces. The transfer of said pieces by means of a main conveyor of the notched belt type ensures a very high accuracy in the positioning of pieces in mutual relationship. The device of the invention makes it possible to achieve a competitive cost for boxes that had hitherto required manual assembling.

Other embodiments and advantages of the invention appear from the following description with reference to the attached drawings showing a preferred form of embodiment of the device of the invention by way of example.

In the drawings:

FIG. 1 is a top plan schematic view of the whole device according to the invention, FIG. 1*a* is a top and right side schematic view of the device of FIG. 1, FIG. 1*b* is a vertical sectional view of the linear main conveyor showing the vacuum chambers and the make up of the individual grooved rails within which the notched belts move horizontally forming principal components of the linear main conveyor, FIG. 1*c* shows enlarged sectional views of two of the grooved rails and the notched belts of the linear main conveyor (not to scale);

FIG. 2 is a front schematic view of the entry side and the mobile carriage,

FIG. 3 is a partial front view showing the stack loader of the margin stop system, FIG. 4 is a partial schematic front view of the margin system conveyor FIG. 5 is an exploded view of the stack loader, FIG. 6 is a front view of the margin stop system consisting of a dual plate and of two stack loaders, FIG. 7 is a side view of the glueing machine, FIG. 8 is a diagramme showing the quality control circuit.

Description of the Preferred Embodiments

Figure 1A:
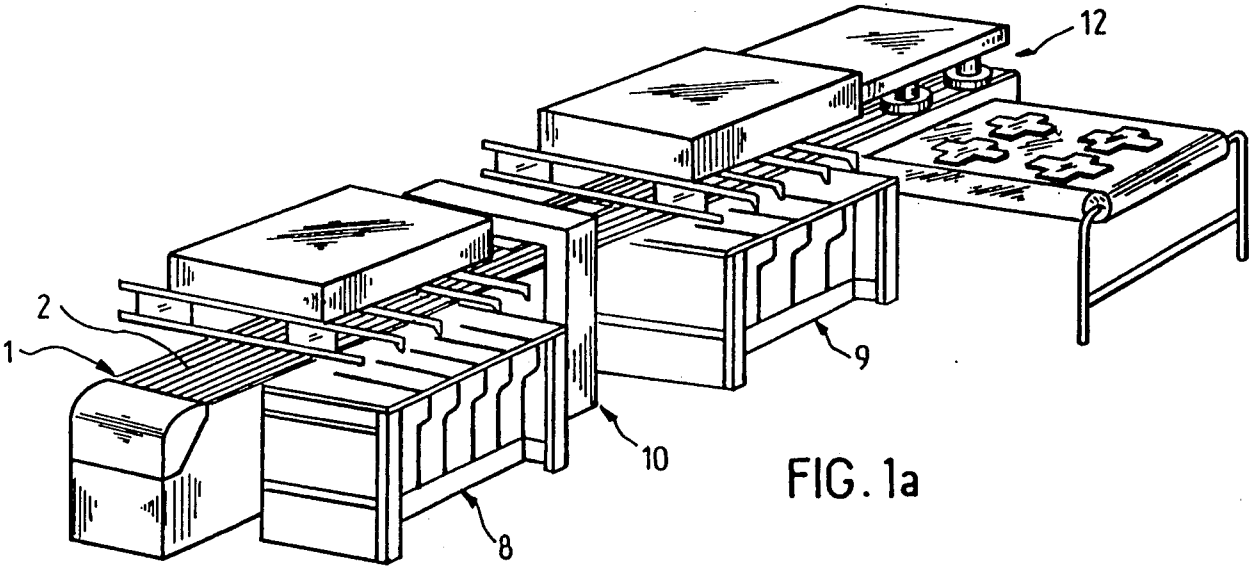
Figure 1C:
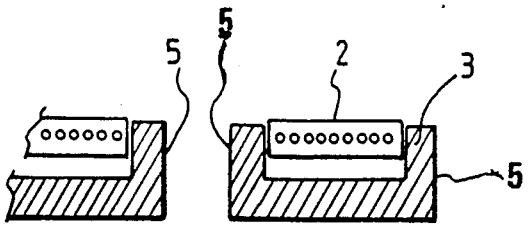
Figure 1B:
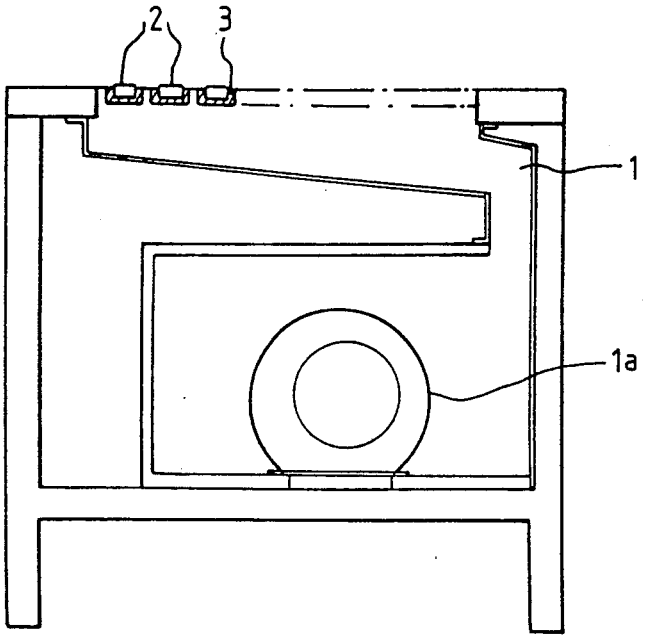

The device of the invention, as shown in FIG. 1, consists of a frame carrying a horizontal linear main conveyor provided with fixed and longitudinal vacuum chambers (1), open at their top to a driving means consisting of notched belts (2) in horizontal arrangement. Work places distributed along said linear main conveyor permit the supply and positioning of cuttings as well as processings such as the glueing of definite portions of said cuttings.

Cuttings are sheets of any configuration, with a thickness ranging from a few tens microns to a few centimeters.

The work places include at least one first margin stop system (8) intended to position a first cutting on the linear main conveyor. Said margin stop system (8) includes at least one stack loader (66) and one conveyor (9) that collects cuttings from the margin stop system (8) and moves them to the entry area of the first cuttings (68) during a stop of the linear main conveyor.

The run of notched belts (2) causes a transfer of the first cutting to the second work place. The accuracy of the transfer is ensured by the adherence of the cutting on the notched belts on account of the vacuum produced by the vacuum chambers (1) as well as the adherence characteristics of the material that said notched belts are made of.

The second work place comprises a glueing machine (10) intended to apply a film of glue in definite portions of the first cutting. Axial accuracy, or accuracy parallely to notched belts (2) is ensured by the accuracy of the transfer of said notched belts and transversal accuracy is ensured by the reproducibility of the positioning of the glueing.

A third work place comprises a second margin stop system (11) intended to position a second cutting or piece on the first glued cutting.

The last or fourth work place the place occurs at (14) of discharge of assembled cuttings.

The number of work places can be obviously increased without departing from the spirit of the invention.

Pattern recognition means (28) provided between work places are intended to check the conformity of cuttings and of their processing. A non-conformity causes the locking of subsequent work places and a discharge at the end of the main conveyor.

In the event of repeated non-conformity cases above a tolerable threshhold, an alarm will be sounded so that the operator can check whether the device is properly set.

The device of the invention includes a vacuum main conveyor consisting of a plurality of vacuum chambers (1) and of notched belts (2). Notched belts (2) are positioned and guided by rails (3) in regular spacing. Both vertical, parallel edges (4) and (5) of rails (3), grooved on the upper face thereof, are spaced substantially the width of notched belts (2) in order to allow for a running of said notched belts (2) within the grooves without clearance. The height of said vertical and parallel rail edges (4) and (5) is slightly less than the thickness of notched belts (2). The spacing between two adjacent rails (3) is selected to be small as compared with the size of cuttings. The spacing is preferably less than one tenth of the smallest dimension of said cuttings.

The vacuum supplied by the vacuum chambers (1) arranged below said rails (3) causes the cuttings placed on the main conveyor to tightly adhere to notched belts (2). Notched belts (2) are made of synthetic material, particularly neoprene featuring a very low skipping rate and elongation.

Mobile vacuum chambers are mounted in adjacent arrangement in order to reduce discontinuity in low pressure. They are connected with a vacuum source.

Notched belts (2) are driven by a drum powered by a motor (7). The motor (7) is of the step-by-step type and the drum (6) is connected to an incremental encoder in order to make possible a precision numeric control.

The pitch is to be selected in order to correspond to a motion of notched belts (2) ranging from 0.02 to 3.0 mm, preferably one tenth of millimeter.

The device of the invention includes work places at (9), (10), (11) and (12) on either side of the main conveyor. The main conveyor ensures the transfer of cuttings and assembled pieces from one work place to another as well as a correct positioning at each work place. Vacuum chambers (1) are connected to a suction system that produces a partial vacuum in said chambers (1).

In a particular embodiment, the low pressure main conveyor is fitted with from 10 to 13 rows of rails (3) and of notched belts (2) and preferably 16 rails (3) and 16 notched belts (2).

Figure 2:
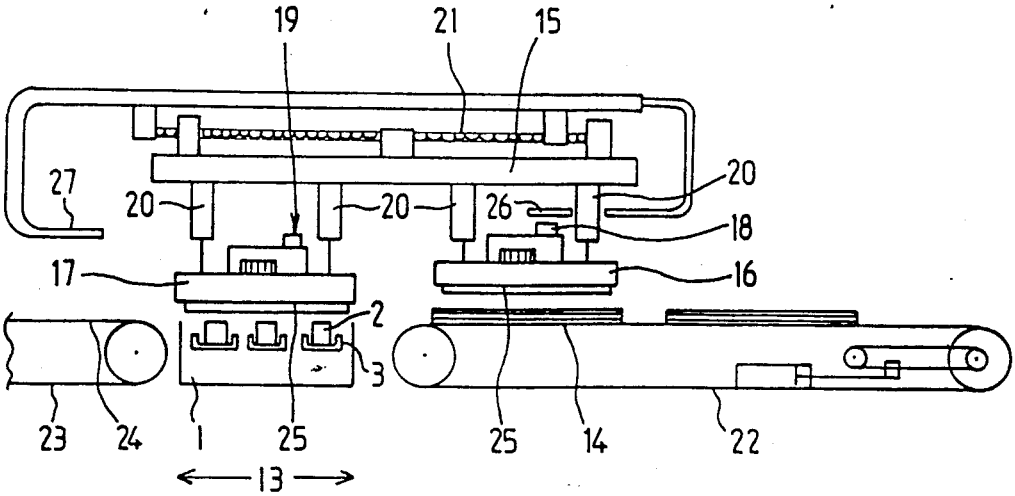

In a particular embodiment, illustrated in FIG. 2, the main conveyor is provided at the exit side with a collection area (13) and a discharge area (14). A mobile carriage (15) supports at least one suction chamber (16) and preferably a second suction chamber (17). Suction chambers (16), (17) are provided with a built-in low pressure system, for instance, an electric fan. Each suction chamber (16), (17) has an air outlet (18), (19) at its top section. Suction chambers (16), (17) are moved vertically by cylinders (20) associated with the mobile carriage (15). The mobile carriage moves horizontally by a ball screw system (21) or any other identical means ensuring a transversal motion of said mobile carriage in respect to the main conveyor. Suction chambers (16), (17) are designed to collect assembled boxes at one end of the main conveyor when they reach the collection area (13) and to move them to the discharge area (14) of a conveyor (22) which carries them to a storage area for example.

In an alternative embodiment, a second rejection conveyor (23) is installed opposite the discharge area, in order to remove non-conformity pieces to a rejection area.

Suction chambers (16), (17) ensure a second function of pressing glued cuttings. The lower surface (25) of suction chambers (16), (17) is made of a perforated grid. Assembled boxes are held by low pressure on suction chambers (16), (17) during the transfer from the collection area (13) to the discharge area (14) or the rejection areas (24). When the suction chamber (1) has moved to a vertical position above the discharge area (14), a fixed closing flap stops air outlet (18). This causes the removal of low-pressure inside the suction chamber (16) and therefore the assembled box held by said suction chamber (16) drops. The assembled box is then removed by conveyor (22) to a storage area. The closing of air outlet (18) causes turbulences that create a slight overpressure inside the suction chamber, thereby improving the laying down of the box.

Similarly, a fixed closing flap (27) provided above the rejection area (24) stops the air outlet (19) or suction chamber (17) when it reaches a vertical position above the rejection conveyor (23). As before, the closing of air outlet (19) of suction chamber (17) causes the low pressure to disappear and creates a slight overpressure that causes the laying down of the assembled box to be rejected.

Downstream of the main conveyor, faulty boxes are discarded onto the conveyor (23) by the suction chamber (17).

In a particular embodiment of this alternative, the device is provided in view of statistical returns with a tolerance entry system for each box.

The counting of pieces and the analysis of velocities make it possible for a computer to make an evaluation of the period required for completing the production.

In another alternative embodiment, the entry of the characteristics of a new series of pieces is made in machine learning by the pattern recognition system.

In the case of repeated non-conformity pieces, the device stops the line so that the defective work place can be adjusted.

In addition the device of the invention includes at least one margin stop system intended to supply the main conveyor with pieces and/or cuttings. The margin system includes at least one stack loader illustrated diagrammatically in FIG. 3 and one conveyor illustrated diagrammatically in FIG. 4.

The stack loader brings a number of cutting opposite the conveyor so that they can be picked up.

Figure 3:
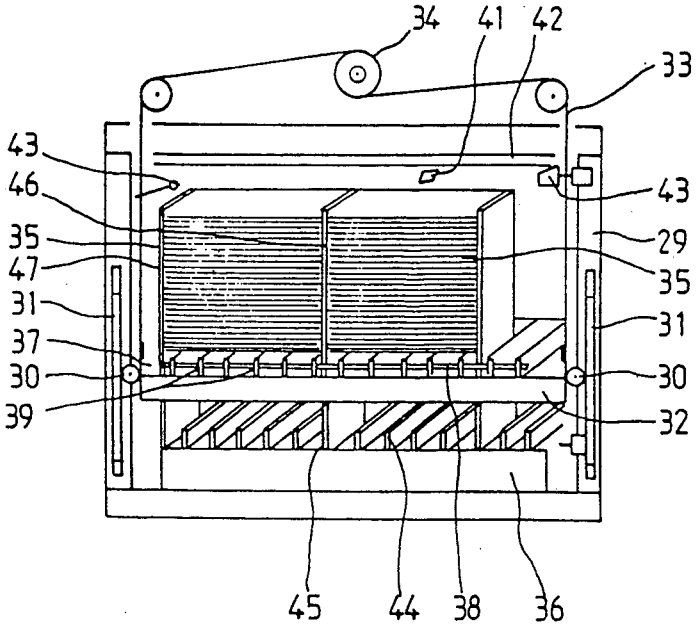

The stack loader, FIG. 3, includes a frame (29) with guide means and a lift frame (32). Linear guiding is achieved by a roller (30) resting on a vertical section (31) mounted to the frame (29).

The lift frame is a rectangular frame (32) moved vertically by means of rope (33) or cables. When the lift frame is moved vertically by cables, said cables are powered by a N.C. electric winch (34). Owing to numerical control, the stack (35) may be positioned vertically with an accuracy of approximately one tenth of micron.

The inner dimensions of said frame (32) are greater than the dimensions of a fixed lower plate (36). The frame (32) carries a rake (37) made of a horizontal section that is arranged in a substantially parallel position to the main conveyor. Section bar (38) is made of aluminium and is fitted with a plurality of horizontal teeth (39) in perpendicular arrangement to the axis of the main conveyor. Teeth are of polyester material. Said rake (37) rests on the lift frame (32), on the two portions parallel to the main conveyor by means of such teeth, the section bar (38) extending beyond said frame (32)

The correct positioning is achieved by a system of studs provided on the portions of the frame that are parallel with rake (37) bar (38). The rake (37) teeth (39) carries one or more stacks (35) when being lifted.

The positioning at the stack top is ensured by one or more vibrators (40) which actuate aligning stoppers (41), designed so that they are easily adjusted in depth and in transverse motion on a vibration belt (42). When pieces and cuttings at the top of the stack (35) come into contact with aligning stoppers (41), said aligning stoppers push, under belt vibration pieces or cuttings to their predetermined position, with the opposite edge of said cuttings abutting against a fixed wall.

In addition, the stack loader includes an optical sensor (43) controlling the raising of the lift frame (32) in order to ensure a constant level for the stack (35) top. As soon as the level of the top of the stack (35) is lower than the reference level determined by the positioning of said optical sensor (43), for instance after the removal of pieces or cuttings from the top of the stack for their lying down onto the main conveyor, the control system transmits commands to the N.C. winch until the level of the top of the stack is again satisfactory, that is substantially level with the top surface of notched belts.

The lower portion of the stack loader includes a fixed bottom plate (36), of open type, consisting of a comb (44) the gaps of which allow for the insertion of the teeth (39) of the rake (37). When the stack (35) has been used up, the rake (37) is extracted by an operator and the lift frame (32) is returned to its lower position, that is lower than the level of the fixed lower plate (36). Then the rake (37) is again inserted into the gaps existing between the lattice-work of the comb (44) and the lower portion of the new stacks is laid down on the fixed lower plate by an operator while the lift frame (32) was still in a high position. The stack loader is then ready for a new operating cycle. The lift frame (32) is again moved vertically, and when both parts parallel with the main conveyor come to touch the teeth (39), said lift frame (32) ensure the raise of the rake (37) and therefore of the new stack (35).

In addition, the lower plate (36) is provided with slides (45) that hold the dividing plates (46), (47) ensuring the lateral positioning of stacks (35). Slides (45) can be adjusted quickly in order to adapt the stack loader to the dimensions of the cuttings or pieces that the stack (35) is made of. To this purpose, the dividing plates (46), (47) are held at their upper portion by adjustable tongues (48), FIG. 5, inserted in a upper graduated rule (49) while their lower potion is held by a slide (45) mounted in lower twin graduated rules (50) and (51).

When a change is scheduled in production, the positioning of tongues (48) and of slides (45) can be prepared on a second set of upper rules (49) and of lower twin graduated rules (50) and (51). The substitution can be carried out quickly by removing the first set of rules and fitting instead the second set prepared separately.

Next the dividing plates are refitted. Dividing plates (46) include thin dogs (52) at their top that ensure a flexible holding of the top sheets of the stack (35). The tongues (48) of the upper graduated rule (49) also include a flexible tappet to provide some retention of the last sheet in the stack. Dogs (52) are in form of a small rubber part.

In addition, the margin stop system includes a conveyor diagrammatically shown in FIG. 4.

Pieces or cuttings available at the top of the stack (35) are picked by a conveyor consisting of a mobile carriage moved horizontally by a ball screw system (55), FIG. 6 poweredby a NC DC-motor (56) that is controlled by an incremental angular encoder (57). The mobile carriage (54) carries a supporting plate (58). Said plate moves vertically through pneumatic or hydraulic cylinders (59). The plate (58) is provided with air cup supports with lateral adjustment according to the size of pieces or cuttings. Air cups (61) are connected with a vacuum pump (62) through a storage cylinder (63) and a vacuum valve (64) to control low-pressure, and with a compressed air source through an injection valve (65).

Operation is as follows: one or more cutting or piece at the top of stack (35) are loosely held by flexible tappets (53) and dogs (52). Air cups (61) are moved by the mobile carriage (54) to a vertical position above the stack loader and the plate (58) is lowered. Air cups (61) touch the upper sheets and low-pressure applied. Air cups 61 consist of a flexible rubber segment. Plate (58) is then raised vertically by cylinders (59) Dogs (52) and the flexible tappet (53) prevent the removal of pieces or cuttings other than those held by air cups. The mobile carriage (54) moves vertically above the collection area for cuttings or pieces and the plate (58) moves vertically downward under the action of said cylinders (59)

When the piece of cutting comes to contact the surface of the main conveyor, the vacuum valve (64) is closed and the injection valve (65) permits a short air supply to the air cup in order to cause the loosening of the sheet. These motions may be flexibly programmed in order to provide a smooth and high-speed action owing to numerical control. The speed of the horizontal motion of the mobile carriage (54) varies gradually between zero and maximum speed.

In an alternative embodiment illustrated in FIG. 6 the margin stop system includes two stack loaders (66), (67), arranged on either side of the surface of the main conveyor as well as a dual plate (58). Said dual plate (58) includes two rows of air cups (69), (70). When the plate (58) is in its bottom position, a series of air cups (69) collects the set of top pieces or cuttings of the stack of the loader (66), during which time the other row of air cups (70) moves the cuttings to the collection area (68). Therefore the conveyor collects a set of cuttings in alternation from either stack loaders (66), (67). When one of the two sets of stacks of the stack loaders (66) or (67) is exhausted, the conveyor only collects sheets from the other loader, during which time the frame (32) of the first conveyor returns to its bottom position with the rake (37) positioned under the new set of stacks (35). Once this is completed, the frame (32) moves upward, driving the rake (37) and the new stacks (35) and the conveyor can return to alternating operation.

This particular embodiment prevents the temporary interruption of the device of the invention during the installation of a new stack of pieces or cuttings (35). Re-load does not affect the work rate substantially, it will be found of advantage to re-load in alternation, first one of the stack loader (66), or (67), then the other.

The device of the invention also includes an arrangement intended to lay a glue film on a portion of the pieces or parts placed on the main conveyor, in automatic processing and high accuracy.

The glueing machine includes a glue feeding system and a cushion holding mobile carriage (71), FIG. 7. The glue feeding system consists of a roller support (72) with three rollers (73), (74) and (75). The supporting frame (72) can be moved vertically by means of cylinders (76). Liquid glue is fed between rollers (73), (74), by a hose controlled by a peristatic pump (82). At the other end, the excess glue is collected and returned to the can (83) through a suitable duct. The glue can be any class of liquid glue for normal use in the paper industry. Rollers (73) and (74) are closely adjacent and rotate in opposing direction. The glue bead (77) is flattened to a film. The film of glue from roller (74) is passed to the applicator roller (75) which rotates in a direction opposite to that of roller (74). A scraper system (78) distributes the glue available on the applicator roller (75) evenly. Smoothing rollers (73) and (74) and the applicator roller (75) are made of smooth plastic material.

The glue cushion carriage (71) includes an aluminium cell-type grid (79) for the fitting of an applicator cushion (80) of the appropriate configuration. The applicator cushion (80) consists of a PVC foam and foam elements corresponding to the glueing surface. The cell grid (79) carries stripping points (81) in portions free of the cushion (80). The purpose of the stripping points (81) is to hold the cutting or the piece on the main conveyor after the application of a film of glue by means of the applicator cushion (80) and during the upward travel of said application cushion (80). The pattern of the applicator cushion (80) and of the position of stripping points (81) is different for each box pattern.

Just as it is possible to prepare the graduated rules (49), (50), (51) and the positioning of adjustable tongues (48) intended to hold the partition plates (46) and (47) of the stack loaders, it is possible to prepare—outside the work place—an applicator cushion by adjusting a new cell grid (79) and a new configuration for the applicator roller (80) as required for the new type of box to be assembled.

In a preferred embodiment, the roller (73) ends rest on laterally adjustable shaft supports (84). The pressing of roller (73) against roller (74) is produced by a pressing spring (85). The purpose of this mode of mounting is to prevent severe damage to an operator's hand if caught by smoothening rollers (73), (74). To improve safety, a switch (86) is provided on each support of adjustable shaft (84) in order to lock roller rotation in case of lateral motion of roller (73).

At the beginning of the cycle, the mobile carriage (71) is at its top position and the roller support is at its bottom position. The mobile carriage (71) moves laterally until it is beyond the applicator roller (75). When the back portion (87) of the applicator cushion (80) has reached a vertical position above the applicator roller (75), the lateral travel of the cushion holding mobile carriage (71) is stopped and the roller support (71) moves to its top position in order to cause a contact between the applicator roller (75) and the foam elements of the applicator roller (80). The mobile carriage (72) then proceeds to the glueing area (88) at a speed in synchronisation with the rotation speed of the applicator roller (75) in order to provide a slipless running of the applicator roller (75) onto the applicator cushion (80)

In an alternative embodiment, a variation is created between the relative speed of the applicator roller (75) and of the applicator cushion (80)—the speed of the applicator cushion (80) being greater than the peripheral speed of the applicator roller (75) on the edges of the glueing area of a foam element—in order to reduce the thickness of the film on the edge and prevent lateral flow. When the applicator cushion (80) reaches a vertical position above the glueing area (88) the applicator cushion (80) returniing to its bottom position, in order to lay the film of glue available on the foam elements of the applicator cushion (80) onto cuttings or pieces to be gummed. Stripping points (81) allow to keep the cutting tight against the glueing area (88) during the initial stage of the vertical motion toward the top of the applicator cushion (80) after the glueing of the sheet. At that time, said stripping points (81) rest against a portion of the cutting that is free of glue. The glued cutting is carried by the main conveyor to the next work place (11) and a fresh cutting is moved onto the glueing area (88). The cycle may be repeated.

In an embodiment of advantage the feeding system also includes a cleaning arrangement consisting of a water supply (89) that supplies water to rollers (73) and (74) after an operation of the device. The rinsing water is collected by a pan (90) and is discharged by a conduct (91). During the rinsing sequence, the applicator cushion (80) is in contact with the applicator roller (75); at this stage, the travelling speed of the cushion-holding mobile carriage (75) and the rotation speed of rollers (73), (74), (75) are no longer synchronised. The rotation speed of the applicator roller (75) is greater than the travelling speed of the applicator cushion, in order to promptly eliminate any glue remaining on the foam elements of said applicator cushion (81).

In a particular example of embodiment shown in FIG. 1, along the main conveyor consisting of low-pressure chambers (1), of notched belts (2) and of rails (3), work places consist of a margin stop system including a stack loader (8) a glueing machine (10), a second margin stop system including a stack loader and mobile carriage (12)

The first series of cuttings are stacked on the stack loader (8). A mobile conveyor places said cuttings on the notched belts (2) of the main conveyor. The conformity of the cutting and its correct positioning are checked by a C.C.D. camera (28) connected to a pattern recognition system/ If a fault is found, a command is emitted to the work places downstream of the faulty or poorly positioned cutting in order to stop their operation during transit of the cutting concerned and cause the rejection of said cutting at the exit of the main conveyor. In this way a substantial saving in materials is made possible. If the piece conforms and is properly positioned, it reaches the next work place: a gumming machine (10). The main conveyor stops when the piece reaches the glueing area (88) and the applicator cushion applies a film of glue at the predetermined spots. A C.C.D. camera connected with a pattern recognition system can check the correct gumming of the cutting, for instance, by analising the diffusion properties of said cutting. Similarly the glued cutting is automatically rejected in the case of lack of conformity.

If the piece meets the specifications, the next work place (11) consisting of a second margin stop system, permits the laying down of a second piece or cutting onto the preglued cutting. To this purpose, the main conveyor stops when the pre-glued cutting reaches the collection area (68)

Again, a C.C.D. camera (28) connected with a pattern recognition system checks the correct positioning of the second cutting.

The work place (13) includes a mobile carriage (12) that, on the one hand, provides the pressing of the second cutting on the glued cutting, and on the other hand, moves the assembled box toward a conveyor (22) that carries said box to a storage position, or, if there is a non-conformity, to a rejection conveyor. (23)

All working places are arranged at equal distance along the conveyor in order to make possible the synchronisation of the different operations carried out by each working place.

The N.C. motor (7) is controlled in order to ensure a smooth running of notched belts (2) with progressive acceleration and deceleration between each shifting. A specific program permits a highly flexible and accurate control of all motions of the main conveyor and of the mobile carriages.

In a form of embodiment of special advantage, the main conveyor of the invention includes cameras (28) illustrated in FIG. 1 and preferably the so-called C.C.D. cameras or load transfer cameras placed between the work places (8), (9) (10), (11) and (12). Said C.C.D. cameras (28) are associated with a pattern recognition system, of numeric and/or radiation characteristics type, more specially in the visible and infrared spectrum, that permits, when pieces leave any working place, to chek them for conformity against a range of reference values that are specific for each product. If a piece is not in conformity with the programmed tolerances, the subsequent working places receive commands to the effect that they do not process the piece concerned. This prevents the loss of materials that otherwise would be spent in processing incorrect pieces.

The utilization of signals issued by cameras (28) is made by technique known to the man in the art.

As an example, the electronic circuit of signals emitted in real time by C.C.D. cameras (28) will be as shown by the diagram of FIG. 8. This electronic circuit utilizes techniques of microprocessor programing and signal processing means already known in the art.

The utilization program includes a learning stage and an operating stage.

For the learning stage, a first cutting is run on the main conveyor.

The transit of the cutting in front of each C.C.D. cameras causes the corresponding signal transmitted by said camera to be entered. After formatting and processing, the signal is stored and becomes the reference for cutting characteristics.

As long as the operator has not validated the learning stage, the program acquires the characteristics of reference cuttings and adjusts the stored data for instance by the method of weighted least error squares.

When the operator validates the learning stage, the reference characteristics are stored in the systeme memory for each C.C.D camera, as corresponding to the signal entered at the transit of a conform cutting.

Then the system is switched over to the operating stage.

When a cutting from a upstream work place enters the detection range of a C.C.D. camara, the corresponding signal is formatted in real time and compared with the reference signal as memorized during the learning stage. In the event of conformity, that is when a mathematical function that is the difference between the acquired signal and the reference signal has a value lower than a threshhold, the operation of the downstream work places is not stopped.

If the function value is higher than a fixed threhhold, the program causes the downstream work places to stop operating and the cutting considered is discarded at the end of the main conveyor.

On the other hand there is an incrementation of an error counter.

If the rate of errors exceeds a fixed threshhold, an audible or visible alarm is released and the system causes the device's operation to stop in order to allow an inspection of the work places with eventual further setting.

In an alternative embodiment of advantage, the program also includes cutting counting functions and statistical analysis means in order to predict, say, the time required to complete a series of cuttings.

This invention is not restricted to the above-described examples but, on the contrary, it covers all alternative and particular embodiments.

I claim:

1. A device for assembling cuttings, more specially for the production of packing boxes, of the type including a plurality of work places arranged along a vacuum main conveyor, said work places including: a first work place comprising a first margin stop system (8) with at least one stack loader (66) and a conveyor (9) for positioning a first cutting on said main conveyor, a second work place comprising at least one glueing machine (10) for applying a film of glue on at least a portion of the first cutting and a third work place comprising at least one second margin stop system (11) including a stack loader and a conveyor for placing a second cutting on the first cutting, characterized by the fact that said main conveyor is a linear and horizontal conveyor and includes a plurality of notched belts (2), guided respectively in upwardly open grooved vertical rails (3), each of said rails being imperforate and having parallel vertical edges (4,5), whose groove depth is slightly less than the thickness of a corresponding notched belt (2) placed therein, said notched belt (2) being drum driven to a position above at least one fixed longitudinal and linear vacuum chamber with an opening at the top thereof and extending below said belts and said rails to apply vacuum between said rails against said cuttings on said belt but not against said belts within said imperforate rails.

2. A device according to claim 1, characterized by the fact that notched belts (2) are driven by a N.C. step-by-step motor.

3. A device according to claim 1, characterized by the fact that said main conveyor includes at its exit side a discharge area (14) for assembled cuttings and is provided with a mobile carriage (15) carrying at least one suction chamber (16) that moves transversely to the axis of the main conveyor between a position above the main conveyor and a position above the discharge conveyor (22)

4. A device according to claim 3, characterized by the fact that the suction chamber (16) an air outlet (18) that co-operates with a fixed closing flap (26) when the mobile carriage (15) reaches a position above said discharge area (14).

5. A device according to claim 1, characterized by the fact that said main conveyor includes at least one pattern recognition system with C.C.D. cameras for checking the conformity of cuttings and of their processing against a reference and to cause the rejection of faulty parts at the exit of the main conveyor.

6. A device according to claim 1, characterized by the fact that the stack loader includes a lift frame (32) that supports a retractable rake (37), said rake having spaced teeth (39), and a fixed lower plate (36) internally of said lift frame, of open-lattice type, consisting of a comb (44) whose gaps allow the insertion of said teeth (39) of said rake (37).

7. A device according to claim 6, characterized by the fact that the stack loader includes a fixed lower plate (36) provided with adjustable slides (45) fixed on twin graduated rules (50), (51), and adjustable tongues (48) arranged on an upper graduated rule (49), for holding, "dividing" plates (46), (47), that ensure the lateral positioning of cutting stacks (35).

8. A device according to claim 6 characterized by the fact that the stack loader includes an optical senses (43) for stack exhaustion.

9. A device according to claim 1, characterized by the fact that the margin stop system includes a conveyor made of a mobile carriage (54) driven horizontally by a ball screw system (55), said mobile carriage (54) carrying a vertically mobile plate (58) provided with air cups (61) that are connected with a vacuum pump and with an air supply system.

10. A device according to claim 9, characterized by the fact that the margin stop system includes two stack loaders (66), (67), in symmetrical arrangement and mutual opposition on either side of the main conveyor, and a mobile carriage (54), carrying a double plate (58) provided with two rows of air cups (69), (70), with one row of air cups collecting a set of cuttings on the top of the first loader and the other row of air cups collecting a set of cuttings on the top of the other loader.

11. A device according to claim 1, characterized by the fact that said glueing machine consists of a glue feeding system including a roller support (72), at least two smoothening rollers (73), (74) and at least one applicator roller (75) a peristatic pump for supplying glue between said smoothening roller (73), (74), through a duct, as well as a cushion-holding mobile carriage (71) fitted with a cell-type grid (79) for the adaptation of an applicator cushion (80) including foam elements whose configuration corresponds to that of the glueing surface.

12. A device according to claim 11, characterized by the fact that said cell-type grid (79) bears stripping points (81) intended to tightly hold the glued cutting (25) against the glueing area (88) of the main conveyor when the cushion-holding carriage (71) moves upward.

13. A device according to claim 11 or 12, characterized by the fact that said glue feeding system includes a water supply (89) for rollers (73), (74) and (75) and a collecting pan (90) for rinsing water.

14. A device according to claim 11, characterized by the fact that at least one of the smoothening rollers (73) is mounted on a laterally mobile shaft support (84), the mutual pressure of smoothening rollers (73) and (74) being achieved by pressing rollers (85) mounted on the shaft support (84) and the shaft of the smoothening roller (73).

15. A device according to claim 11, characterized by the fact that the travel speed of the applicator cushion (80) is higher than the rotation speed of the applicator roller (75) at the edges of the foam elements of the applicator cushion (80)

16. A device according to claim 1 characterized by the fact that it includes a numerical control system that controls the run and stop cycles of the main conveyor as well as the operation of the various work places.

17. A device according to claim 16, characterized by the fact that said N.C. system provides a gradual acceleration and deceleration of the progress of notched belts (2).

* * * * *